US005918574A

United States Patent [19]

Kobayashi

[11] Patent Number: 5,918,574

[45] Date of Patent: Jul. 6, 1999

[54] GAS CANISTER HOLDER FOR A COMPACT ENGINE

[75] Inventor: Yoshio Kobayashi, Nagoya, Japan

[73] Assignee: Mitsubishi Heavy Industries, LTD., Tokyo, Japan

[21] Appl. No.: 08/988,403

[22] Filed: Dec. 10, 1997

[30] Foreign Application Priority Data

Dec. 10, 1996 [JP] Japan ..... 8-329817

[51] Int. Cl.[6] ..... F02F 7/00

[52] U.S. Cl. ..... 123/195 A; 123/198 R

[58] Field of Search ..... 123/195 A, 198 R

*Primary Examiner*—Noah P. Kamen

*Attorney, Agent, or Firm*—Birch, Stewart, Kolasch & Birch, LLP

[57] ABSTRACT

In a compact gas engine using a liquefied gas for a fuel, a gas canister holder for holding a fuel gas canister is provided. The gas canister holder includes a case having a gas canister outlet and inlet port and a cap axially engaged with the gas canister outlet and inlet port of the case. A pusher brought into contact with an end surface of the gas canister outlet and inlet port of the case and brought into contact with an end surface of the gas canister attached to an inner portion of the case is disposed between the case and the cap. A spring for urging the pusher and the cap in a direction taking these apart from each other is provided between the pusher and the cap. Accordingly, even when the gas canister is not attached within the case, the urging force is applied to the cap by the pusher and the spring, so as to prevent the cap from being disengaged with the case.

5 Claims, 6 Drawing Sheets

GAS CANISTER HOLDER FOR A COMPACT ENGINE

BACKGROUND OF THE INVENTION

1. Field of the Invention

The present invention relates to a gas canister holder for holding a gas canister filled with a liquefied gas in a compact engine using liquefied gas as a fuel.

2. Description of Background Art

In a compact gas engine using liquefied gas mainly containing a butane gas charged in the gas canister as a fuel, a gas canister holder is provided for detachably attaching the gas canister so as to connect a carburetor chamber in the engine.

A compact gas engine is shown in FIG. 7 as an embodiment of the conventional compact gas engine. In FIG. 7, 1 denotes a compact gas engine and this compact gas engine 1 is constituted by parts mentioned below. A crank case 2, includes a cylinder 3 fixed to an upper portion of the crank case 2 and having an air intake port 4 and an exhaust port 5. A muffler 6 communicates with the exhaust port 5. A mixer 7 includes an air passage 8 and an amount adjusting chamber 9 communicating with an air passage 10. An air cleaner 11 provides outside air and feeds to the mixer 7. A muffler cover 12 communicates with the muffler 6.

A crank shaft 13 is supported by the crank case 2. A crank arm 14 is provided in the crank shaft 13. A connecting rod 15 is provided for connecting a crank pin 16 and a piston pin 17. A piston 18 and an ignition cap 19 are provided in a top portion of the cylinder 3.

Further, a gas canister holder 21 is provided for holding a cassette type gas canister A filled with a liquefied petroleum gas, and the gas canister holder has a cylindrical case 22 fixedly attached to a lower portion of the crank case 2. An end portion of the case 22 is provided with a gas canister outlet and inlet port 22*a* for taking in and out the gas canister A. A cap 23 is inserted and fitted into an inner portion of the gas canister outlet and inlet port 22*a* in the case 22 so as to be held thereby, and a compression coil spring 24 is provided for pushing the gas canister A.

A carburetor chamber case 31 is provided on the other end portion of the case 22, and the carburetor chamber case has an injection port 32 to which a nozzle-shaped discharge port B provided in a front end portion of the gas canister B is inserted. Further, a pressure adjusting device 33 is provided adjacent to a fuel passage connecting between the carburetor chamber case 31 and the pressure adjusting device 33. A fuel passage 35 connects the pressure adjusting device 33 and the amount adjusting chamber 9 of the mixer 7.

A structure for holding and fixing the cap 23 to the case 22 in the gas canister holder 21 will be described below with reference to FIG. 8. FIG. 8 is a drawing as seen from a Z direction in FIG. 7. An engaging groove 25 is formed on a peripheral wall surrounding the gas canister outlet and inlet port in the case 22 at regular intervals in a circumferential direction, and an engaging hook 26 engaging with and disengaging from the engaging groove 25 is formed on a peripheral wall of the cap 23. Accordingly, the engaging groove 25 substantially has an L shape and comprises an insert and non-insert portion extending along an axial direction of the case 22 and an engaging portion having a portion continuing the insert and non-insured portion so as to extend along a peripheral direction and a portion continuing the peripheral portion so as to extend along the axial direction. The engaging hook 26 is inserted into the insert and non-insert portion of the engaging groove 25 so as to move along the peripheral portion of the engaging and disengaging portion and is again returned along the axial portion so as to be engaged. As mentioned above, the cap 23 is inserted into the outlet and inlet port 22*a* of the case 22 and rotated to the peripheral direction so as to be mounted in a bayonet manner. In the case of removing the cap 23 from the case 22, the inverted operation to the operation mentioned above is performed.

When the gas canister A is fitted to the inner portion 4 of the case 22 and the cap 23 is fitted and fixed to the case 22, an end surface portion of the outlet and inlet port 22*a* side of the gas canister A is pressed by the compression coil spring 24 provided in the cap 23. Accordingly, the discharge port B provided in the opposite end portion is brought into contact with the injection port 32 of the carburetor chamber case 31 so as to be kept in an air tight state, and as it is pressed inward the gas canister discharge valve of the canister A is opened. Accordingly, the gas fuel corresponding to the liquid charged in the gas canister A enters into the carburetor chamber case 31 and is gasified. The gas fuel gasified within the carburetor chamber case 31 successively passes through the passage 34, the pressure adjusting device 33, the passage 35, the amount adjusting chamber 9 in the mixer 7 and the passage 10 so as to enter into the air passage 8 in the mixer 7 and is mixed with the air so as to be fed to the inner portion of the cylinder 3 through the air intake port 4.

In the gas canister holder in the compact gas engine in accordance with the conventional art, the following problems exist.

In the case where the gas canister A is fitted to the inner portion of the case 22 so as to fit and hold the cap 23 to the case 22, the case 23 receives a force toward the inner portion of the cap (rightward in FIG. 7) through the compression coil spring 24 from the base end portion of the gas canister A, and the engaging hook 26 of the cap 23 receives a force toward the opposite direction to the case of the cap 23 (leftward in FIG. 7) from the portion along the peripheral direction in the engaging groove 25 of the case 22. Therefore, the cap 23 fitted to the case 22 is held by two pressing forces opposite to each other mentioned above. On the contrary, in the case where the cap 23 is fitted to the case 22 at a time when the gas canister A does not exist in the inner portion of the case 22, the spring 24 does not work and the forces mentioned above do not respectively act, so that the cap 23 is free with respect to the case 22. Therefore, there is a risk that the engaging hook 26 of the cap 23 freely moves within the engaging groove 25 of the case 22 during transit of the engine 1 so that the cap 23 gets out of place from the case 22 and further the removed cap 23 is lost.

The cap 23 fitted to the conventional case 22 is formed by pressing the metal plate. However, in the case where the compact gas engine 1 is used for a machine operating outdoors for a long time, in summer season, the metal cap 23 becomes hot if exposed to direct sunshine, so that there is a risk that the operator is burned when the operator holds the engine with unprotected hands. On the contrary, in the case where the compact gas engine 1 is used for a machine operating outdoors for a long time, the gas canister A is replaced relatively frequently. In the case of replacing the gas canister A, the operator holds the cap 23 and attaches the cap to and detaches the cap from the case 22. In this case, as mentioned above, in the summer season, since the temperature of the cap 23 is high, there is a risk that the cap 23 may burn the operator's unprotected hands.

BRIEF SUMMARY OF THE INVENTION

The present invention is made on the basis of the above matters, and an object of the present invention is to provide a gas canister holder in a compact gas engine in which an operability of a cap mounted to a case is improved.

In the gas canister holder in accordance with the present invention, the case and the cap mentioned above are axially engaged with each other, and the cap is attached to a gas canister access port of the case. Further, a pusher disposed between the case and the cap is provided. The pusher is brought into contact with at least a part of an end surface of the gas canister access port of the case. Further, a spring for urging the cap and pusher in such a manner as to axially take them apart from each other is disposed between the cap and the pusher.

Accordingly, even when the gas canister is not inserted into the case, the pusher is brought into contact with the end surface of the gas canister access port of the case and the spring urges the cap to the direction apart from the pusher, that is, the case. The fitting and engagement of the cap is maintained due to the urging force, so that the cap does not fall off during transportation.

Further, in the case where the gas canister is attached within the case, since the gas canister is urged to the front end side through the pusher by means of the spring, the function for attaching the gas canister is not affected.

Still further, in accordance with a preferred embodiment of the present invention, a hub is formed in the center portion of the pusher and a shaft is provided in the center portion of the cap in a projecting manner so that the hub and the shaft are fitted to each other in such a manner so as to freely slide in an axial direction at a predetermined distance. Accordingly, since the cap and the pusher are integrally connected to each other, the pusher is not lost.

Moreover, in accordance with a preferred embodiment of the present invention, the cap is made of a synthetic resin material. Since the synthetic resin material generally has a low heat conductivity, in the case where the cap is at a high temperature, even when the operator attaches and detaches the cap with unprotected hands, there is no risk that the hands are burned, and the cap can be inexpensively and efficiently manufactured by the injection molding.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
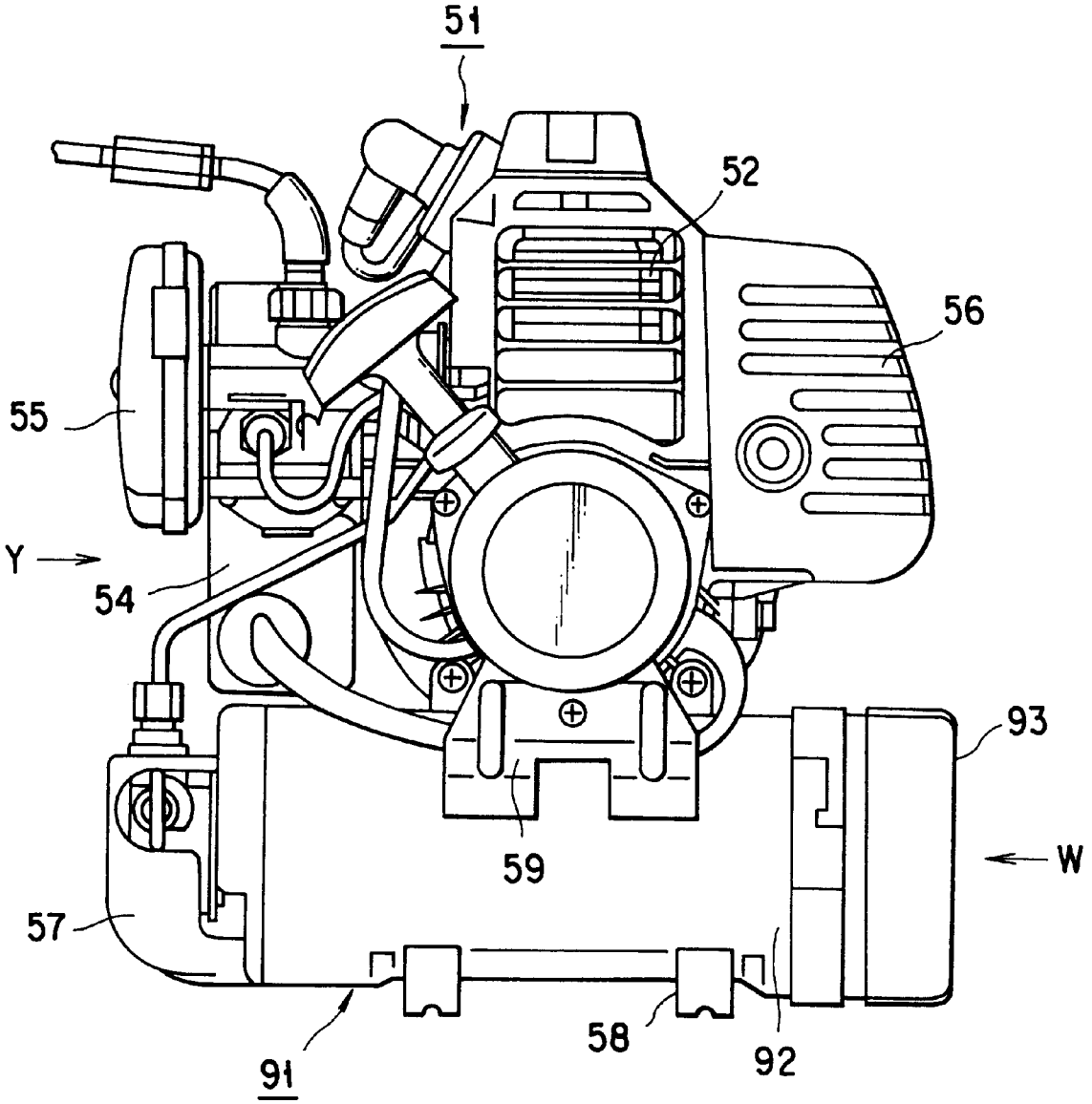
FIG. 1 is a front elevational view which shows a compact gas engine provided with a gas canister holder in accordance with an embodiment of the present invention.
Figure 2:
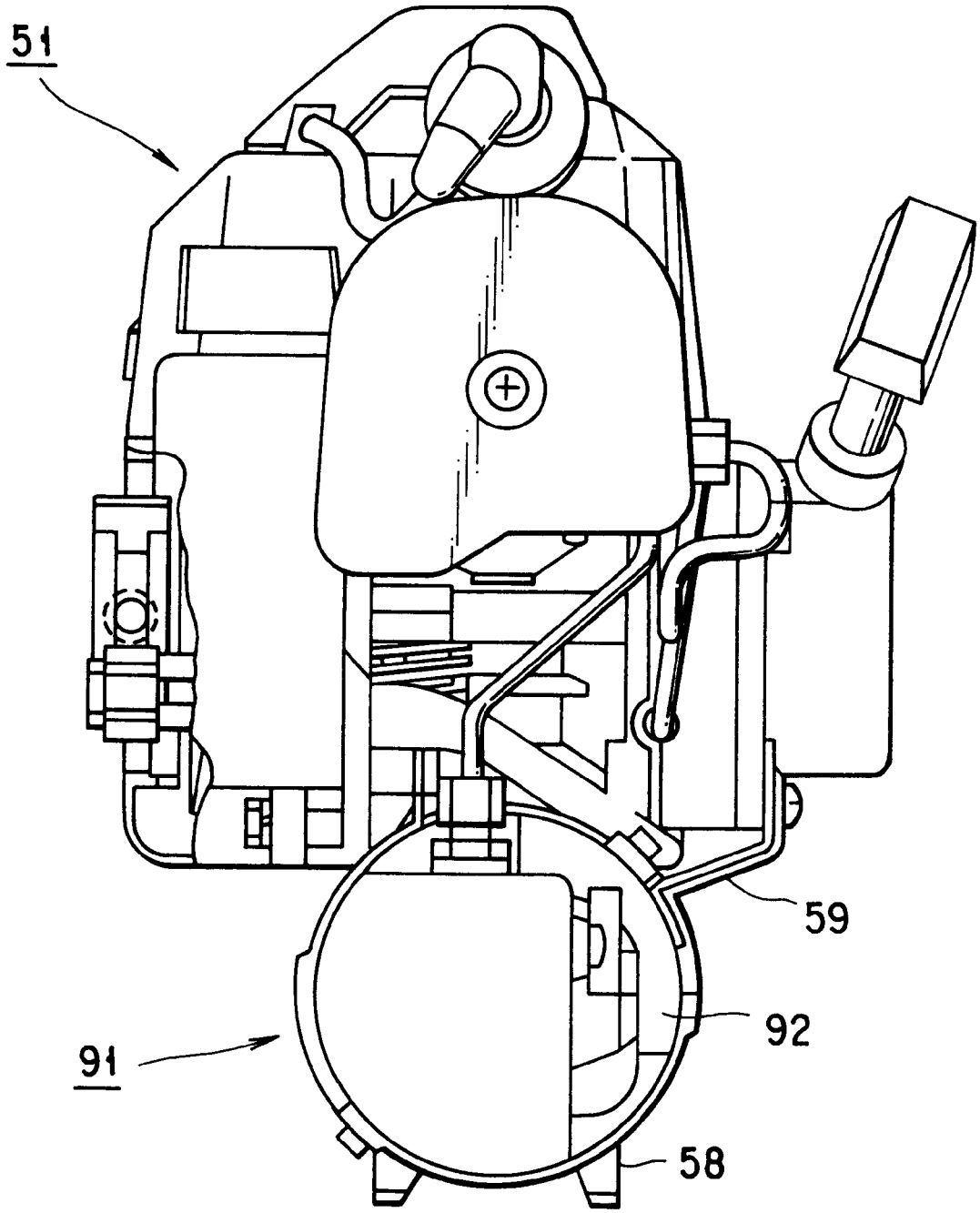
FIG. 2 is a side elevational view which shows a compact gas engine in accordance with the embodiment.

An embodiment in accordance with the present invention will be described below with reference to FIGS. 1 to 6. FIG. 1 is a front elevational view showing an outer appearance of a compact gas engine, and FIG. 2 is a schematic view as seen from a Y direction in FIG. 1. In FIGS. 1 and 2, a compact gas engine 51 is provided with a cylinder for the gas engine 51. A crank case 53 is provided for the gas engine 51. A mixer 54 is provided for the gas engine 51. An air cleaner 55 provides air to the gas engine 51. A muffler cover 56 is connected to the gas engine 51. A gas canister joint 57 is provided for the gas engine 51. In this case, since the compact gas engine 51 is the same as the prior known engine, the explanation thereof will be omitted.

Figure 3:
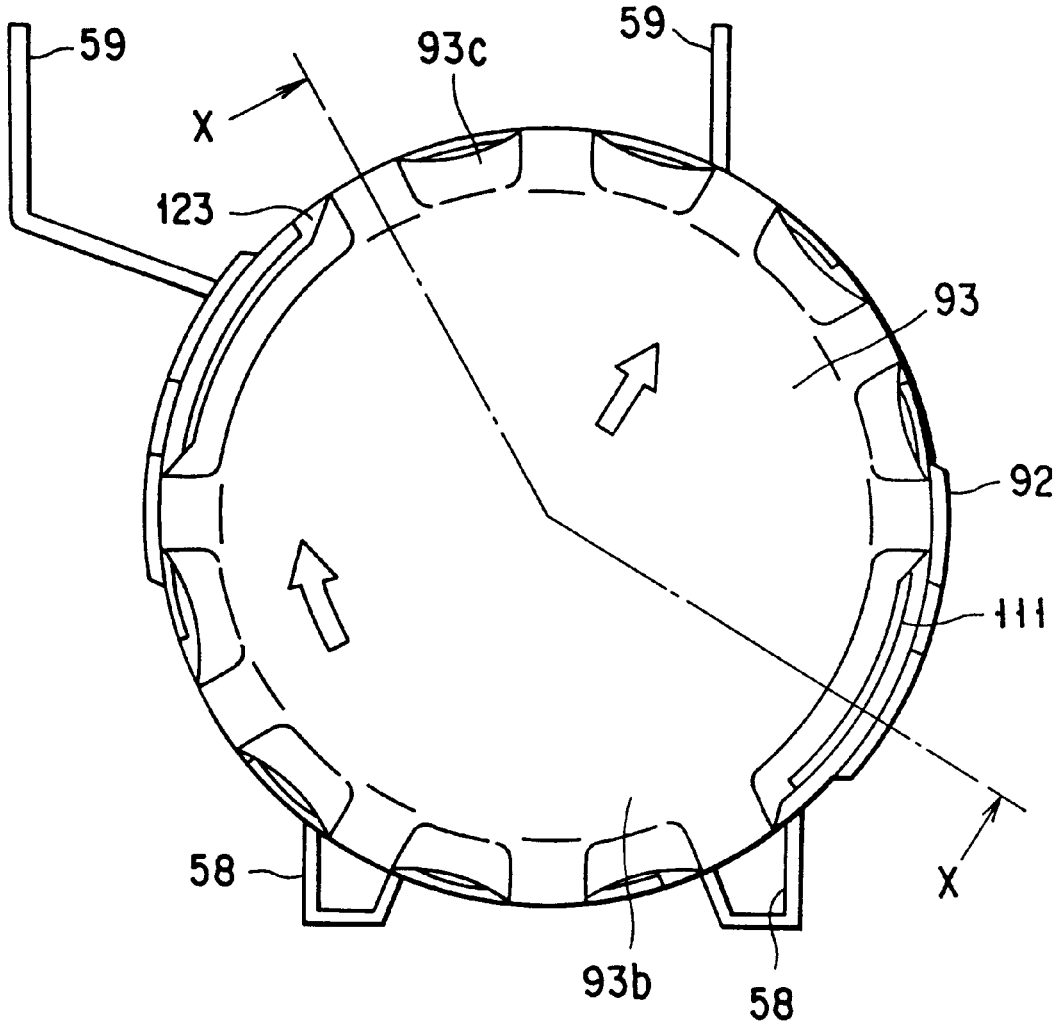
FIG. 3 is a schematic view as seen from a cap end which shows a gas canister holder in accordance with the embodiment.
Figure 4:
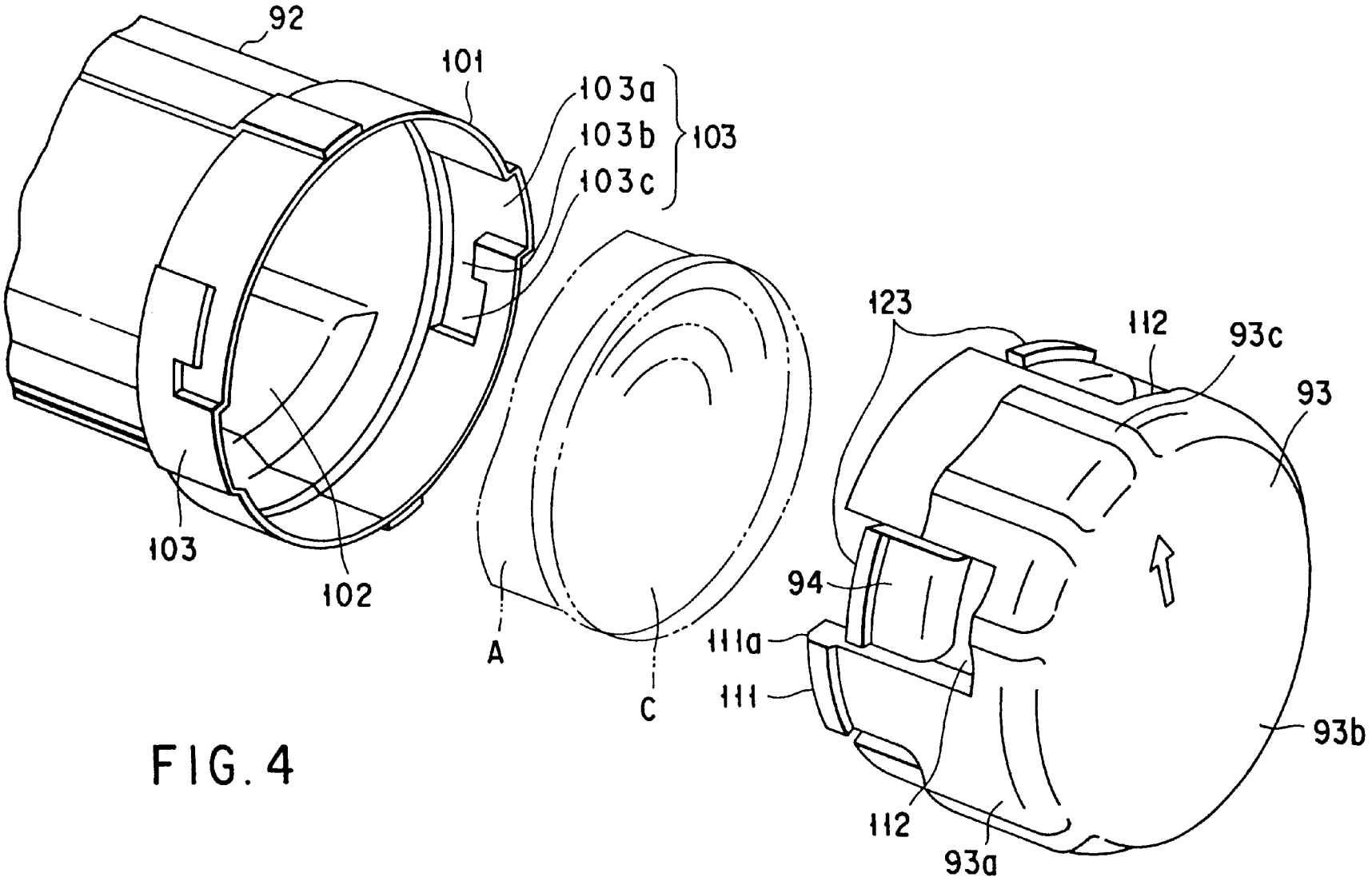
FIG. 4 is an exploded perspective view which shows a case and a cap of the gas canister holder in accordance with the embodiment.
Figure 5:
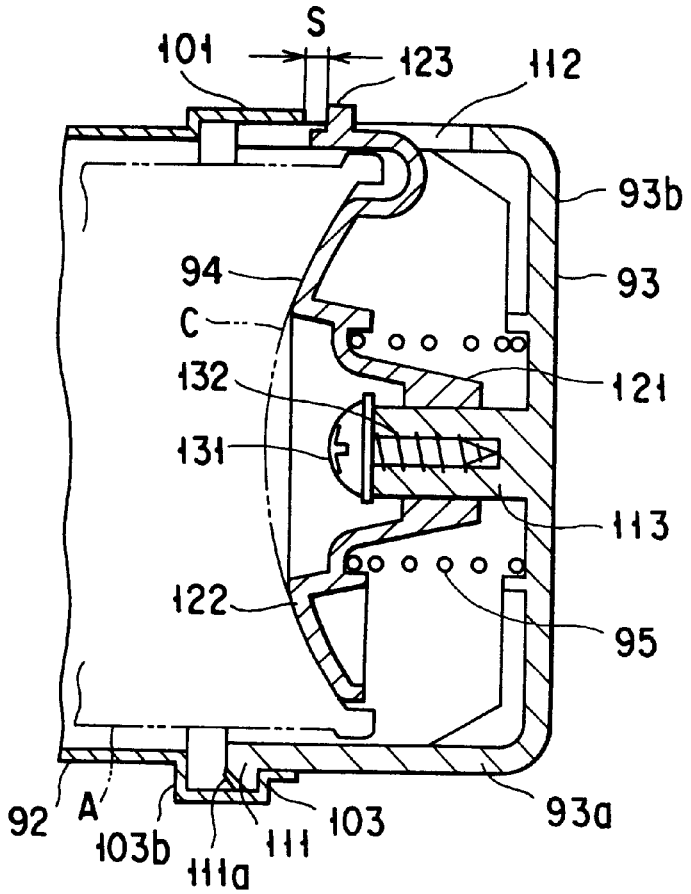
FIG. 5 is a cross sectional view which shows the case and the cap of the gas canister holder in accordance with the embodiment.
Figure 6:
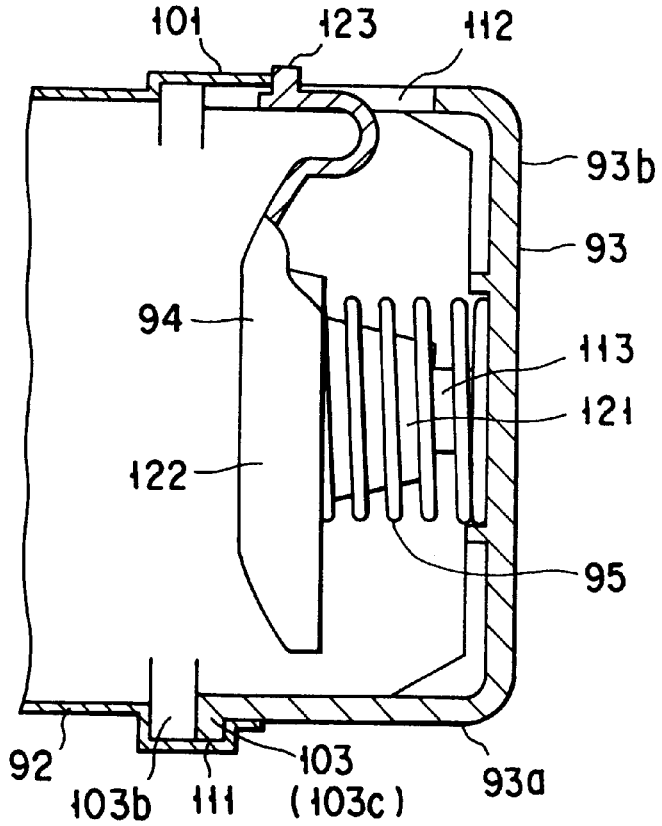
FIG. 6 is a cross sectional view which shows another state of the case and the cap of the gas canister holder in accordance with the embodiment.
Figure 7:
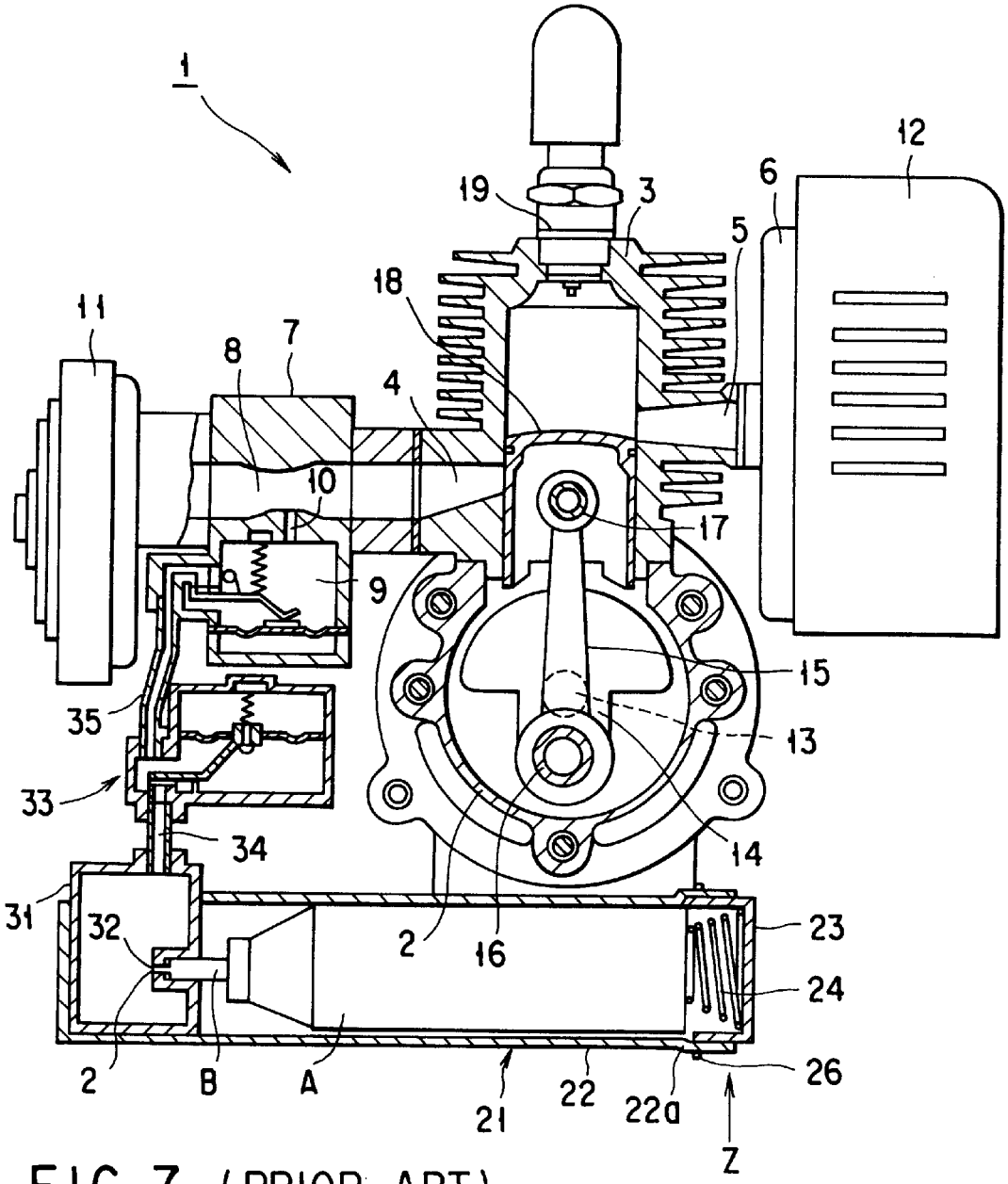
FIG. 7 (PRIOR ART)
FIG. 7 is a front elevational view which shows a compact gas engine provided with a conventional gas canister holder.
Figure 8:
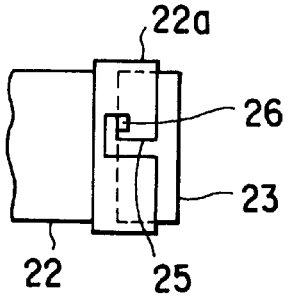
FIG. 8 (PRIOR ART)
FIG. 8 is a side elevational view which shows a case and a cap of the conventional gas canister holder.

In FIGS. 1 and 2, a gas canister holder 91 is provided for holding the gas canister, which is a subject of the present invention and is provided below the compact gas engine 51. FIG. 3 is a drawing as seen from a W direction in FIG. 1, FIG. 4 is an exploded perspective view showing a cap and FIGS. 5 and 6 are cross sectional views taken along a line X—X in FIG. 3. The gas canister holder 91 has a case 92, a cap 93, a pusher 94 and a compression coil spring 95, as shown in FIGS. 1 to 5. In this embodiment, the gas canister A also has a cylindrical shape as shown in FIG. 7 and has a nozzle-shaped discharge port B at a front end portion.

The case 92 is formed as a cylindrical body made of a thin iron plate, is provided with a leg 58 and a bracket 59 and is horizontally disposed below the compact gas engine 51 so as to also serve as a support table for the compact gas engine 51. An end portion (a right end portion in FIGS. 1 and 4) of the case 92 is opened in such a manner so as to have a diameter greater than a diameter of a body portion for serving as a gas canister access port 101, and as shown in FIG. 4, a bed 102 for supporting the gas canister A is formed in the lower portion of the body portion.

Further, as shown in FIG. 4, a plurality of, for example, two engaging grooves 103 having a substantial L shape are formed on a peripheral wall surrounding the gas canister access port 101 in the case 92 at a position at a regular interval in the circumferential direction by an emboss processing which embosses outward from the inner portion of the gas canister access port 101. In a bottom surface portion of the engaging groove 103, the wall portion surrounding the gas canister access port 101 forms as a top plate. The engaging groove 103 has a first vertical groove 103*a* extending along an axial direction of the case 92 and opening to the end portion of the peripheral wall in which the end disposed in the outer portion of the case surrounds the gas canister access port 101, a horizontal groove 103*b* extends along a peripheral direction of the case 92 and continues on the inner end of the case of the first vertical groove 103*a*. A second vertical groove 103*c* extends in parallel to the first vertical groove 103*a* and has a short length not reaching the end portion of the peripheral wall surrounding the gas canister access port 101 and continues to the horizontal groove 103*b* at the inner end of the case. In this case, the first vertical groove 103*a* constitutes an insert and noninsert portion corresponding to a portion to which an engaging hook of the cap 93 is inserted and non-inserted, and the horizontal groove 103*b* and the second vertical groove 103*c* constitute an engaging portion with which the engaging hook is engaged.

In this case, although the illustration is omitted, the other end portion of the case 92 is engaged with the discharge port B of the gas canister A as in the same manner as the conventional example so as to take out the liquefied gas charged in the gas canister A to the gas canister joint 57.

The gap 93 is made of a synthetic resin such as a polypropylene and the like, and is inserted and fitted to the gas canister access port 101 of the case 92. The cap 93 has a circular peripheral wall 93*a* inserted into the gas canister access port 101 and an end wall 93*b* closing an end portion (a right end portion in FIGS. 4 to 6) of the peripheral wall 93*a*. Further, a plurality of, for example, two engaging hooks 111 inserted into and engaged with the engaging groove 103 of the case 92 are formed in an open edge portion of the peripheral wall 93*a* in the cap 93 at a position (a position opposite to each of the engaging grooves 103 of the case 92) having an interval in the peripheral direction. Each of the engaging hooks 111 has a width corresponding to a width of the engaging groove 103, and is projected on the outer surface of the peripheral wall 93*a* so as to engage with the engaging groove 103. A plurality of, for example, four guide grooves 112 extending in the axial direction of the cap 93 are formed in the peripheral wall 93*a* in the cap 93 at a position (a position except each of the engaging hooks 111) having an interval in the peripheral direction, and the guide grooves 112 are opened at the open edge portion in the peripheral wall 93*a*. In FIG. 4, only two guide grooves 112 among the four guide grooves 112 are shown. A shaft 113 extending along the axial direction toward the open portion of the peripheral wall 93 in the center of the end wall 93*b* is formed in the inner portion of the cap 93 in FIGS. 5 and 6. In this case, as shown in FIGS. 3 and 4, a slip prevention projection 93*c* is formed on the peripheral wall 93*a* of the cap 93. A beveling portion 111*a* is formed on a front end of the engaging hook 111.

The pusher 94 is made of a synthetic resin such as a polypropylene and the like, and is disposed within the cap 93 as shown in FIG. 5. The pusher 94 has a hub 121 fitted and held to the shaft 113 of the cap 93 in such a manner as to freely slide for a predetermined distance in the center portion thereof, so that the pusher 94 is connected to the cap 93, thereby preventing the pusher 94 from being lost.

Further, a circular gas canister pusher 122 brought into contact with an end surface C of the gas canister A is attached to the inner portion of the case 92 and is formed on the outer peripheral portion of the hub 121. The gas canister pusher 122 has a shape corresponding to the cross sectional shape of the reference surface C, for example, a spherical shape in cross section in such a manner as to be smoothly fitted into the end surface C of the Gas canister A. A sliding hook 123 slidably combined with the guide groove 112 of the cap 93 and having an elasticity is formed on the outer peripheral portion of the gas canister pusher 122.

The same number of the sliding hooks 123 as the number of the guide groove 112 of the cap 93, for example, four (the case having two sliding hooks are shown in FIG. 4) sliding hooks are radially formed at a regular interval, and the sliding hook 123 has a width corresponding to the width of the guide groove 112. Further, as shown in FIG. 5, the sliding hook 123 is formed such as to take a long way around the peripheral edge portion of the reference surface C of the gas canister A attached to the inner portion of the case 92 and projects to the outer peripheral side in such a manner as not to interfere with the peripheral edge portion at a time of inserting and fitting the cap 93 to the gas canister access port 101 of the case 92 so as to be fitted into the guide groove 112 of the cap 93, and is structured such that a front end of the sliding hook 123 of the pusher 94 pressed by the coil spring 95 is brought into contact with and engages with the end portion of the peripheral wall surrounding the gas canister access port 101 at a time of inserting and fitting the cap 93 to the gas canister access port 101. Accordingly, the pusher is prevented from rotating with respect to the cap 93.

The coil spring 95 is disposed in such a manner as to surround the hub 121 of the pusher 94 within the cap 93 and is supported by the end wall 93*b* of the cap 93 and the hub 121 of the pusher 94. These members can be rationally disposed, and the assembly comprising the cap 93, the pusher 94 and the like can be made compact. The coil spring 95 applies a elastic force towards the outer portion of the cap 93 with respect to the pusher 94, that is, towards the case 92 at a time of inserting and fitting the cap 93 to the gas canister outlet and inlet port 101 of the case 92. Therefore, the pusher 94 is pressed toward the case 92 by the coil spring 95. In this case, a washer 132 fixed by a screw 131 screwed to the cap 93 is provided in the front end of the shaft 113 of the cap 93, and the washer 132 restricts the distance that the pusher 93 pressed by the coil spring 95 moves towards the case 92.

An operation of the gas canister holder 91 constructed in the above manner will be described below.

At a time of attaching the gas canister A to the inner portion of the case 92, at first, the cap 93 mounted to the gas canister access port 101 of the case 92 is removed so as to open the gas canister outlet and inlet port 101. Accordingly, the cap 93 is slightly pressed and rotated in a counterclockwise direction in FIG. 3, so as to move the engaging hook 111 of the cap 93 engaging with the second vertical groove 103*c* of the engaging groove 103 in the case 92 to the first vertical groove 103*a* through the horizontal groove 103*b* and draw outward from the first vertical groove 103*a*. Therefore, the cap 93 is removed from the case 92.

Next, the gas canister A is inserted into the inner portion (the left side in FIG. 5) of the case 92 from the gas canister access port 101 with firstly inserting the discharge port B, and the gas canister body portion is mounted on the bed portion 102 of the case 92 and is lightly pressed. As shown in FIG. 5, the cap 93 is covered over the reference surface C of the gas canister A and the gas canister pusher 122 of the pusher 94 is brought into contact with the reference surface C. At the same time, the engaging hook 111 of the cap 93 presses the peripheral wall of the case 92 corresponding to the bottom surface or the first vertical groove 103*a* outward with the suitable elastic force by being inserted into the inner portion of the first vertical groove 103*a* of the engaging groove 103 in the case 92 from the opening thereof. Further, the gas canister pusher 122 of the pusher 94 presses the gas canister A.

After the front end of the gas canister A is brought into contact with the other end portion of the case 92 and stopped, the cap 93 is further moved to the inner portion of the case 92 while compressing the compression coil spring 95 and the cap 93 is further rotated in the clockwise direction in FIG. 4 at a time when the engaging hook 111 reaches the horizontal groove 103*b* of the engaging groove 103 so that the engaging hook 111 is moved to the second vertical groove 103*c* of the engaging groove 103. When the force pressing the cap 93 is loosened, the engaging hook 111 is brought into contact with and engaged with the outer end of the case in the second vertical groove 103*c* since the cap 93 is pressed to the outer portion (the right in FIG. 5) of the case 92 by the compression coil spring 95. Accordingly, the cap 93 is inserted and fitted to the gas canister access port 101 of the case 92 so as to be fixed. During the above, the discharge port disposed in the front end of the gas canister A is pressed inward due to the elastic force of the compression coil spring 95 so as to open the valve, and the front end of the discharge port is communicated with the inner portion of the gas canister joint 7. Therefore, the preparation of the gas engine start is completed.

Here, in the case that the gas canister A is attached to the case 92, as shown in FIG. 5, the gas canister pusher 122 of the pusher 94 is brought into contact with the bottom surface portion C of the gas canister A and stopped, so that a gap S is generated between the end surface of the sliding hook 123 of the pusher 94 and the end portion of the gas canister access port 101 of the case 92. The engaging hook 111 of the cap 93 is brought into contact with and engaged with the outer end surface of the case of the second vertical groove 103*c* in the engaging groove 103 of the case 92. Further, the pusher 94 receives the pressing force towards the outer portion of the case, that is, the inner portion of the cap (right in FIG. 5) through the gas canister pusher 122 from the gas canister A, and the cap 93 receives the pressing force towards the inner portion of the cap through the compression coil spring 95 from the pusher 94. Further, the cap 93 receives the pressing force toward the inner portion of the case (left in FIG. 5) and the axial center of the case 92 through the engaging hook 111 from the case 92. Accordingly, the cap 93 and the pusher 94 are securely held and fixed to the case 92, and the gas canister A is securely held and fixed to the case 92 by means of the cap 93 and the pusher 94, so that the gas canister A can be stably held with respect to the outer vibration.

In the case of taking out the gas canister A from the case 92, the cap 93 is rotated in the counterclockwise direction in FIG. 4 so as to remove the engaging hook 111 from the engaging groove 103, and the cap 93 is taken out from the case 92 so as to open the gas canister access port 101 of the case 92, so that the gas canister A is removed from the gas canister outlet and inlet port 101.

Thereafter, as shown in FIG. 6, the cap 93 is inserted and fitted to the gas canister access port 101 of the case 92 and is rotated in the clockwise direction so as to insert the engaging hook 111 in the engaging groove 103 and engage with the second vertical groove 103*c*. In this case, the pusher 94 is moved to the case 92 at a degree of the gap S between the end surface of the sliding hook 123 and the end portion of the gas canister access port 101 of the case 92, so that the end surface of the sliding hook 123 is brought into contact with and engaged with the end portion of the gas canister access port 101 of the case 92. Accordingly, the pusher 94 receives the pressing force towards the outer portion of the case, that is, the inner portion of the cap (right in FIG. 5) from the end portion of the gas canister access port 101 of the case 92, and the cap 93 receives the pressing force towards the inner portion of the cap through the compression coil spring 95 from the pusher 94. Further, the cap 93 receives the pressing force towards the inner portion of the case (left in FIG. 5) and the axial center of the case 92 through the engaging hook 111 from the case 92. Accordingly, the cap 93 and the pusher 94 are securely held and fixed to the case 92, so that the cap 93 and the pusher 94 are stable with respect to the outer vibration.

As mentioned above, even when the Gas canister is not attached to the case, the cap 93 is fixed to the case 92 so that the cap 93 is prevented from being taken out from the case 92. Accordingly, the operability of the cap 93 can be improved and the compact gas engine 51 can be transferred with having no fear of falling off the cap 93.

Further, since the cap 93 is made of a synthetic resin, the cap is not heated even when the compact gas engine 51 is used outdoors and receives direct sunshine, so that the operator can safely treat the cap with unprotected hands. Even when the compact gas engine 51 is employed with the machine used outdoors, the gas canister A can be easily replaced.

The present invention is not limited to the embodiment mentioned above, and can be modified in a variety of ways. For example, in the embodiment mentioned above, the engaging groove 103 of the case 92 has the second vertical groove 103*c* and the engaging hook 111 engaged therewith. This case is effective in fixing the cap 93, however, the case is not limited to this, and when the engaging hook 111 is engaged with the horizontal groove 103*b* without forming the second vertical groove 103*c*, the cap 93 can also be fixed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

I claim:

1. A canister holder for detachably holding a fuel gas canister in a compact engine comprising:

a cylindrical case mounted to an engine body and having a central axis including a canister access port for inserting the fuel gas canister in an end portion;

a cap detachably fitted to said access port of the case;

a locking means locking with said case in such a manner as not to axially move said cap and holding the cap in the end portion of said case;

a pusher disposed between the canister access port of said case and said cap, brought into contact with at least a part of the end surface of the canister access port of the case, and brought into contact with the end surface of the canister inserted into the case; and a spring disposed between said pusher and the cap and urging the pusher and said cap to a direction axially apart from each other.

2. The canister holder for a compact engine according to claim 1, wherein a center portion of said pusher includes a hub, a shaft is axially provided in the center portion of said cap and projects therefrom, and said hub and the shaft are fitted to each other in such a manner as to axially slide for a predetermined distance, so that said cap and the pusher are connected to each other.

3. The canister holder for a compact engine according to claim 2, wherein at least a sliding hook is radially provided in the hub of the center portion of said pusher and projects therefrom, an axially continuing guide groove is formed in an outer peripheral wall of said cap in correspondence to said slide hook, and said sliding hook is fitted into the guide groove in such a manner as to freely slide to an axial direction.

4. The canister holder for a compact engine according to claim 3, wherein said spring is a coil spring and the coil spring is coaxially disposed with said hub and the shaft in such a manner as to surround the hub and the shaft.

5. The canister holder for a compact engine according to claim 1, wherein said cap is made of a synthetic resin material.

* * * * *